United States Patent [19]

Masuda et al.

[11] Patent Number: 4,672,503

[45] Date of Patent: Jun. 9, 1987

[54] ELECTRIC FIELD FORMING APPARATUS

[75] Inventors: Senichi Masuda, Tokyo; Isamu Fukuura, Aichi; Hisaharu Shiromizu, Aichi; Naotoshi Morita, Aichi, all of Japan

[73] Assignee: NGB Spark Plug Co., Ltd., Aichi, Japan

[21] Appl. No.: 727,437

[22] Filed: Apr. 26, 1985

[30] Foreign Application Priority Data

Apr. 28, 1984 [JP] Japan ..... 59-63623[U]

[51] Int. Cl.[4] ..... H01T 19/00; G03G 15/02

[52] U.S. Cl. ..... 361/230

[58] Field of Search ..... 361/233, 234, 229, 230, 361/231, 232; 214/10.81; 427/96, 123, 282

[56] References Cited

U.S. PATENT DOCUMENTS 3,634,740 1/1972 Stevko ..... 361/234
3,970,905 7/1976 Itoh et al. ..... 361/233
3,993,821 11/1976 Goss ..... 427/282 X
4,289,829 9/1981 Rossetti ..... 427/282 X

*Primary Examiner*—L. T. Hix
*Assistant Examiner*—D. Rutledge
*Attorney, Agent, or Firm*—Finnegan, Henderson, Farabow, Garrett and Dunner

[57] ABSTRACT

An electric field forming unit that has a long surface life, high reliability, and provides a uniform surface corona discharge along the entire length of the discharge electrode. The electric field forming unit includes a dielectric substrate made of a fine ceramic having a discharge electrode and an inductive electrode formed on opposite sides thereof. The discharge electrode has peripheral edges which are provided with a better linearity than a discharge electrode formed from an electroconductive paste by screen printing. The discharge electrode may be formed of a metalized tape in a thin line form.

5 Claims, 4 Drawing Figures

ELECTRIC FIELD FORMING APPARATUS

BACKGROUND OF THE INVENTION

The present invention generally relates to an improved electric field forming device used either as an ion generating unit in an electrophotographic copier or as an ozone gas generator. More particularly, the invention relates to an electric field forming device of the type wherein an RF high voltage is applied between a discharge electrode and an inductive electrode formed on opposite sides of a ceramic dielectric substrate.

The discharge electrode of an electric field forming unit of the type contemplated by the present invention is formed on a ceramic dielectric substrate by the screen printing of a paste of electroconductive powder. The nature of the screen printing technique is such that a discharge electrode having smooth edges or one having a good linearity cannot be obtained, and a surface having an unevenness of 40 microns or more is not infrequent. As a result, no uniform corona discharge is obtained along the periphery of the screen-printed discharge electrode, even if an RF high voltage is applied between that electrode and an inductive electrode.

SUMMARY OF THE INVENTION

Accordingly, an object of the present invention is to provide an electric field forming unit which is improved over the conventional device in that it has a discharge electrode of good linearity and it ensures a uniform electric discharge.

Another object of the invention is to provide an inexpensive electric field forming unit that is long lived, exhibits high reliability, and ensures a uniform surface corona discharge along the entire length of the discharge electrode.

DESCRIPTION OF THE PREFERRED EMBODIMENTS

Figure 1:
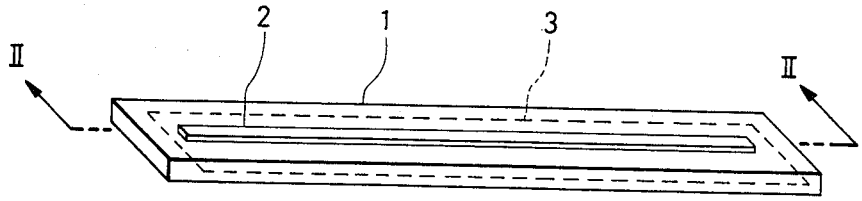
FIG. 1 is a perspective view of an electric field forming unit according to a preferred embodiment of the present invention.
Figure 2:
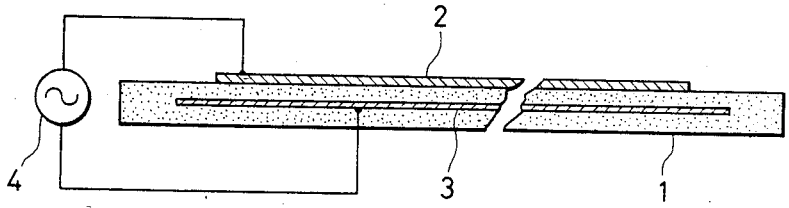
FIG. 2 is an enlarged cross section of FIG. 1 taken on a line II—II.
Figure 3:
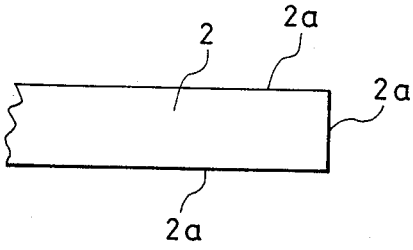
FIG. 3. is a partial enlarged plan view of FIG. 1.

With reference to FIGS. 1 and 2, the present invention provides an electric field forming unit including a substrate made of a fine ceramic or a like material which has a discharge electrode and an inductive electrode formed on opposite sides. According to the present invention, the periphery of the discharge electrode is provided with a better linearity than an electrode formed from an electroconductive paste by screen printing. The unevenness of the peripheral edge of the discharge electrode in the present invention is not greater than 30 microns, typically not more than 10 microns.

The dielectric substrate is made of a material selected from among oxide ceramics such as high-purity alumina porcelain, crystalline glass ceramic, forsterite, steatite and piezoelectric porcelain, as well as non-oxide ceramics such as silicon nitride and silicon carbide. The discharge electrode used in the present invention is generally in the form of a tungsten metallized tape or molybdenum metallized tape. Such discharge electrode and the inductive electrode are preferably provided on opposite sides of the dielectric substrate. Alternatively, the discharge electrode can be formed on the obverse surface of the substrate while the inductive electrode is embedded within the thick-walled portion of the substrate. When an RF high voltage is applied between the discharge and inductive electrodes, a corona discharge occurs which is generated along the periphery of the discharge electrode and spreads on the surface of the dielectric substrate.

EXAMPLE

An alumina powder mixed with 2 wt % magnesia, 2 wt % calcia, and 4 wt % silica was wet ground in a ball mill for 50 to 80 hrs, followed by dehydration and drying. The dried powder was mixed with 3 wt % isobutyl methacrylate, 1 wt % nitrocellulose, and 0.5 wt % dioctyl phthalate. After addition of trichloroethylene and n-butanol as solvents, the resulting mixture was blended in a ball mill to form a flowable slurry. Following defoaming under vacuum, the slurry was cast in a flat sheet form and the solvents were evaporated by mild heating so as to form two green high-alumina sheets, one having a thickness of 0.2 mm and the other a thickness of 1 mm. A tungsten powder composed of micron-sized particles was shaped into a green sheet (thickness 50 microns) by the same procedure.

Figure 4:
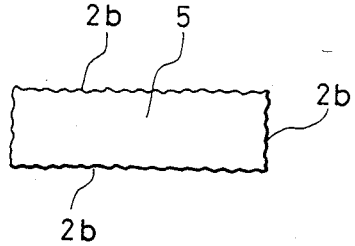
FIG. 4 PRIOR ART
FIG. 4 is a corresponding partial enlarged plan view of the conventional product.

An inductive electrode was silk-screen printed onto the 1-mm thick green high-alumina sheet. Subsequently, the other green high-alumina sheet (0.2-mm thick) was placed over the inductive electrode, and a tape of the green tungsten sheet was placed over that high-alumina green sheet. The respective sheets were pressed together and the assembly was fired at 1400° to 1600° C. in a nonoxidizing atmosphere. The tungsten discharge electrode 2 formed integrally with the dielectric substrate had a periphery 2*a* whose edges were smoother than the jagged (sawtoothed) edges on the periphery 2*b* of the conventional discharge electrode 5 shown in FIG. 4. The thus-prepared discharge electrode 2 was connected to one terminal of an RF high voltage source 4 and the buried inductive electrode 3 to the other terminal.

The unevenness of the peripheral edges of the discharge electrode 2 was 8 microns at maximum, which was by far smaller than the maximum unevenness of the edges of conventional discharge electrode formed by the silk-screen printing technique. As a natural consequence of this smoothness of the peripheral edges of the discharge electrode, a uniform discharge could be obtained over the entire length of that electrode.

In the embodiment shown above, the tungsten discharge electrode was in the form of a tape cut from a sheet prepared by doctor blading a metallized paste of tungsten powder. Alternatively, the same paste may be extruded in tape form, which is used as the discharge electrode in the device of the present invention.

As described above, the discharge electrode of the electric field forming unit of the present invention is provided with peripheral edges which have a better linearity than the edges of the conventional discharge electrode formed by screen-printing a conductive paste. Because of this better linearity of the periphery of the discharge electrode, the device of the present invention is capable of producing a uniform corona discharge along the entire length of the discharge electrode. If good linearity of the peripheral edges of the discharge electrode is provided by using a metallized tape, great latitude in the thickness of the discharge electrode is possible. In addition, a uniform electrode can be readily obtained, ensuring further improvement in the evenness of the corona discharge created by the device of the present invention. Therefore, the electric field forming unit of the invention presents considerable advantages when used for ion generation in an electrophotographic copier or production of ozone gas.

We claim:

1. An electric field forming unit for producing a corona discharge, said unit comprising:

a ceramic dielectric substrate having at least one planar surface;

an induction electrode embedded in said dielectric substrate, spaced from said surface; and a discharge electrode disposed on and integral with said planar surface, said discharge electrode being a metal paste tape having edges of linearity sufficient to create a uniform corona discharge.

2. An electric field forming unit according to claim 1, wherein said metal paste tape is comprised of tungsten powder.

3. An electric field forming unit according to claim 1, wherein said metal paste tape is comprised of molybdenum powder.

4. An electric field forming unit according to claim 1 wherein said edges of said metal paste tape have a variation in linearity of less than 30 microns.

5. An electric field forming unit according to claim 1, wherein said edges of the metal paste tape have a variation in linearity of less than 10 microns.

* * * * *